US007261291B2

(12) United States Patent
Förch et al.

(10) Patent No.: US 7,261,291 B2
(45) Date of Patent: Aug. 28, 2007

(54) SHEET-PROCESSING ROTARY PRESS WITH A DELIVERY CONTAINING AFTER-GRIPPERS

(75) Inventors: Peter Förch, Neustadt (DE); Markus Möhringer, Weinheim (DE); Paul Nicola, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 465 days.

(21) Appl. No.: 10/694,613

(22) Filed: Oct. 27, 2003

(65) Prior Publication Data

US 2004/0113350 A1 Jun. 17, 2004

(30) Foreign Application Priority Data

Oct. 25, 2002 (DE) ..... 102 49 737

(51) Int. Cl.
*B65H 29/68* (2006.01)

(52) U.S. Cl. ..... 271/183; 271/204

(58) Field of Classification Search ..... 271/183, 271/204

See application file for complete search history.

(56) References Cited

U.S. PATENT DOCUMENTS 3,413,732 A 12/1968 Koch et al.
3,861,672 A 1/1975 Norton
5,011,125 A 4/1991 Spiegel et al.
5,431,386 A * 7/1995 Blaser ..... 271/204
5,988,633 A 11/1999 Henn et al.
6,578,846 B2 6/2003 Maul et al.

FOREIGN PATENT DOCUMENTS

| | | |
|---|---|---|
| DE | 627 851 | 3/1936 |
| DE | 1 260 482 | 2/1968 |
| DE | 24 58 446 A1 | 7/1975 |
| DE | 38 36 254 C1 | 5/1990 |
| DE | 196 28 620 A1 | 1/1998 |
| DE | 100 14 417 A1 | 9/2001 |
| GB | 446462 | 4/1936 |

* cited by examiner

*Primary Examiner*—Patrick Mackey
*Assistant Examiner*—Kaitlin Joerger
(74) *Attorney, Agent, or Firm*—Laurence A. Greenberg; Werner H. Stemer; Ralph E. Locher

(57) ABSTRACT

A sheet-processing machine contains at least one processing station in the form of a printing unit, and a delivery with an endless conveyor and after-grippers that are guided by a mechanism connected to a drive. The after-grippers take over the processed sheets from the endless conveyor and release them over a stack. The sheet-processing machine provides for it to be possible for the mechanism to be set to positions that are correlated with different formats of the processed sheets, and for the drive that actuates the mechanism to keep the mechanism at one and the same phase angle with respect to the printing unit in each of the positions. Therefore, even in the event of different formats of the processed sheets, user-friendly placing of the stack is possible.

8 Claims, 8 Drawing Sheets

SHEET-PROCESSING ROTARY PRESS WITH A DELIVERY CONTAINING AFTER-GRIPPERS

BACKGROUND OF THE INVENTION

Field of the Invention

The invention relates to a sheet-processing machine, in particular a rotary press, containing at least one processing station in the form of a printing unit, a stacking station for holding a stack formed from processed sheets, a delivery with an endless conveyor transporting the processed sheets in the direction of the stack, after-grippers which follow an after-gripper path during operation and which take over the processed sheets from the endless conveyor and release them over the stack, a mechanism guiding the after-grippers, and a drive for actuating the mechanism.

A machine of this type is disclosed in German Patent No. 627 851. The mechanism guiding the after-grippers belonging to the delivery disclosed therein is constructed in the form of two chain drives, whose drive is provided by a gear wheel of the impression cylinder of a preceding printing unit and interposed gear wheels. For the purpose of adapting the delivery to different formats of the processed sheets, the phase angle of the chain drives has to be adjusted with respect to the machine angle setting. Furthermore, the stops provided for forming the stack for the leading edges of the sheet have to be set to a respective position corresponding to the format and precautions have to be taken that opening and closing movements of the after-grippers take place at the correct location in each case. The possible adjustment travel of the after-grippers during the phase adjustment is determined by the length of the chain runs of the mechanism. The length must therefore correspond to the maximum required adjustment travel and thus has a direct influence on the overall length of the delivery.

The trailing edges of the sheets are always deposited at one and the same location, irrespective of their format. In the case of smaller formats, that side of the stack facing an operator and pointing downstream with respect to the transport direction is moved in the direction of the printing unit and, in particular, makes access more difficult, for example for removing a proof or changing the stack.

SUMMARY OF THE INVENTION

It is accordingly an object of the invention to provide a sheet-processing rotary press with a delivery containing after-grippers that overcomes the above-mentioned disadvantages of the prior art devices of this general type, in which accessibility to the stack during the processing of sheets with a format that is smaller than the maximum processable format is not impaired.

With the foregoing and other objects in view there is provided, in accordance with the invention, a sheet-processing machine. The machine contains at least one processing station being a printing unit, a stacking station for holding a stack formed from processed sheets and disposed downstream of the printing unit, a delivery with an endless conveyor transporting the processed sheets in a direction of the stack and disposed downstream of the printing unit, and after-grippers following an after-gripper path during operation for taking over the processed sheets from the endless conveyor and releasing the processed sheets over the stack. A mechanism is provided for guiding the after-grippers. The mechanism is set to positions correlating with different formats of the processed sheets. A drive is provided for actuating the mechanism. The drive keeps the mechanism at one and the same phase angle with respect to the printing unit in each of the positions.

In order to achieve the object, provision is made for the mechanism that guides the after-grippers to be adjustable to positions which are correlated with different formats of the processed sheets, and for the drive that actuates the mechanism to keep the mechanism at one and the same phase angle with respect to the printing unit in each of the positions.

Positions correlated with the different formats of the processed sheets are in this case to be understood to include those which the mechanism assumes in the case of a respective format when the leading edges of the sheets are placed at one and the same location in order to form the stack, irrespective of the format of the sheets, so that even stacks formed from small-format sheets assume the same distance from the downstream end of the delivery as stacks formed from large-format sheets.

In accordance with an added feature of the invention, the mechanism and the drive form one structural unit disposed to be displaced with respect to the delivery.

In accordance with another feature of the invention, the endless conveyor and the mechanism have a torque-transmitting connection with each other. The torque-transmitting connection is a telescopically constructed drive shaft or a flexible drive having an endless flexible drive unit acting on the mechanism. During a change in the positions of the mechanism, the flexible drive is driven such that the mechanism is not actuated.

In accordance with an additional feature of the invention, the endless conveyor contains a first conveyor and a second conveyor. The first conveyor has and bears first gripper bars for gripping leading gripper edges of the processed sheets, and the second conveyor has and bears second gripper bars for gripping trailing gripper edges. A rotary coupling is provided and operates in a first operating state or a second operating state. In the first operating state, the rotary coupling produces a drive connection between the first conveyor and the second conveyor. In the second operating state, the rotary coupling releases the second conveyor for a phase adjustment with respect to the first conveyor. The torque-transmitting connection between the mechanism and the endless conveyor exists with the second conveyor.

In accordance with a further feature of the invention, an actuating drive is provided and has a drive connection to the second conveyor through the rotary coupling in a second operating state of rotary coupling and, in a first operating state of the rotary coupling, the actuating drive is uncoupled from the second conveyor.

In accordance with a further added feature of the invention, a further actuating device actuated rotationally is provided and has an actuating wheel for setting the positions of the mechanism. A drive connection is provided between the actuating wheel and the actuating drive.

In accordance with another further feature of the invention, the delivery has a sheet guide device that can be set to different formats of the processed sheets, and the sheet guide device has ends with clearances formed therein. The after-grippers engage in the clearances and take over the processed sheets from the endless conveyor.

In accordance with another additional feature of the invention, the sheet guide device has a stationary first guide section and a second guide section following the stationary first guide section in a direction of the stack and adjoins the stationary first guide section. The second guide section can be adjusted for accommodating different formats of the processed sheets. The first stationary first guide section and the second guide section have mutually facing end sections which inter-engage in a manner of a comb, and the clearances are formed in the second guide section.

Other features which are considered as characteristic for the invention are set forth in the appended claims.

Although the invention is illustrated and described herein as embodied in a sheet-processing rotary press with a delivery containing after-grippers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The subject of the invention can be used irrespective of whether the sheet-processing machine contains a delivery whose endless conveyor clasps the sheets only at their leading edges or a delivery whose endless conveyor also clasps the trailing edges.

In the first of the aforementioned cases, in order to guide the sheets in the delivery, recourse can be had, for example, to the teaching disclosed in German Patent No. 627 851 but whose application is recommended only when the sheets are to be printed exclusively on one side.

Figure 1:
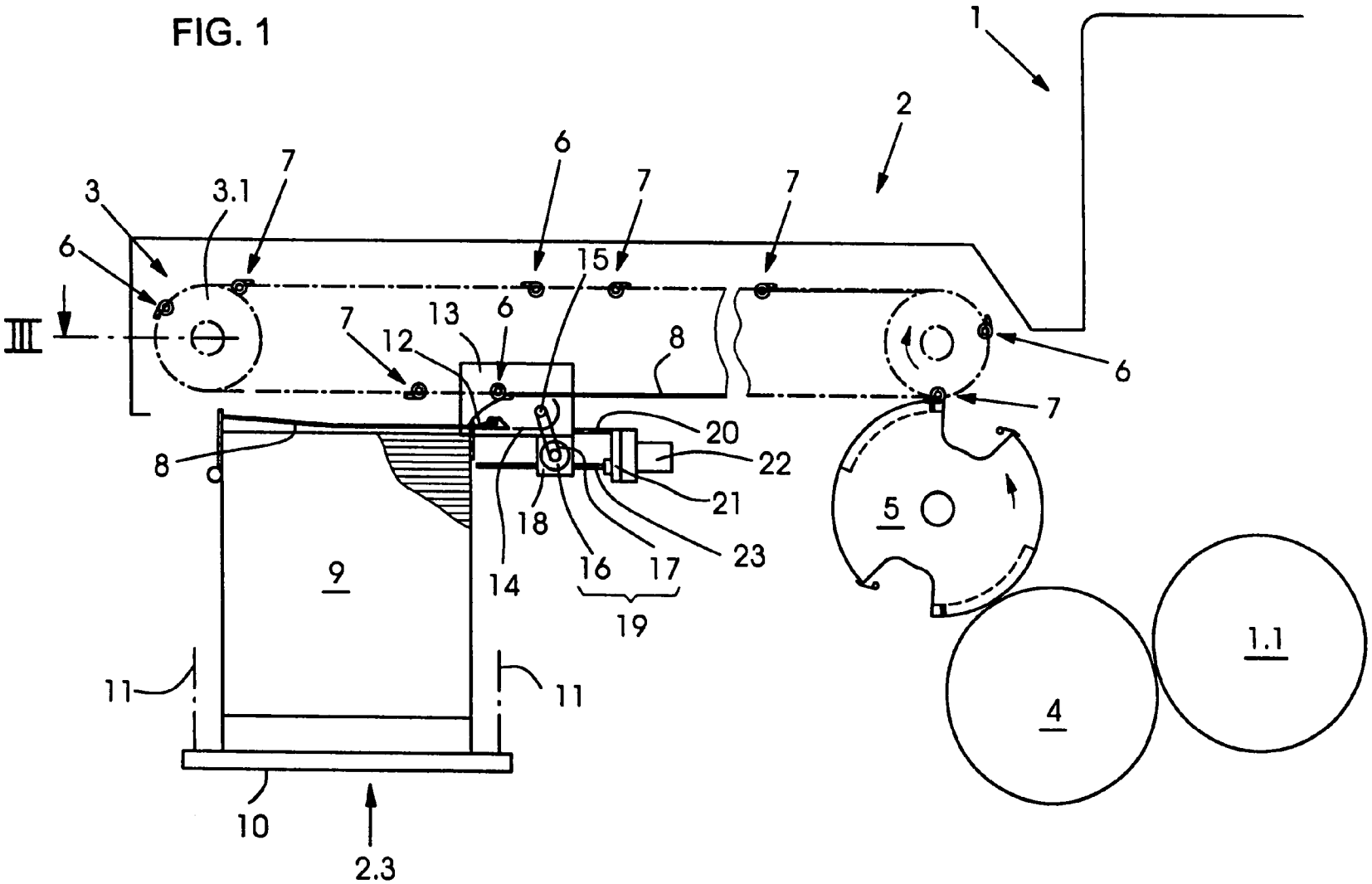
FIG. 1 is a schematic illustration of a section of a sheet-processing machine which contains a delivery, and, by way of example, is constructed as a rotary press and whose delivery, by way of example, is configured in such a way that the processed sheets are guided positively at their front and rear gripper edges, and that, further, according to one configuration of the subject of the invention, the mechanism that guides the after-grippers and the drive actuating the mechanism form a structural unit which is disposed such that it can be displaced.

Referring now to the figures of the drawing in detail and first, particularly, to FIG. 1 thereof, there is shown the case of positive guidance of leading and trailing edges of the sheet, in schematic form. FIG. 1 illustrates in particular a printing unit 1 and a subsequent delivery 2 having an endless conveyor 3.

Although only one printing unit is indicated, it goes without saying that the machine, in its equipment for multicolor printing, contains a corresponding number of printing units, in the case of a machine equipped for recto and verso printing of one side of the sheets in each case with a specific number of colors (including black), twice the number of printing units and a turner station being provided, which transfers sheets 8, optionally turned or unturned, to a subsequent printing unit.

Instead of the printing unit 1, a finishing or post-treatment unit, such as a varnishing unit or a perforating unit, etc., can also be provided as the last processing station upstream of the delivery 2.

Moreover, it goes without saying that a feeder loading the machine with the sheets is connected upstream of a first processing station, the feeder, just like the delivery, advantageously being equipped for non-stop operation.

Figure 3:
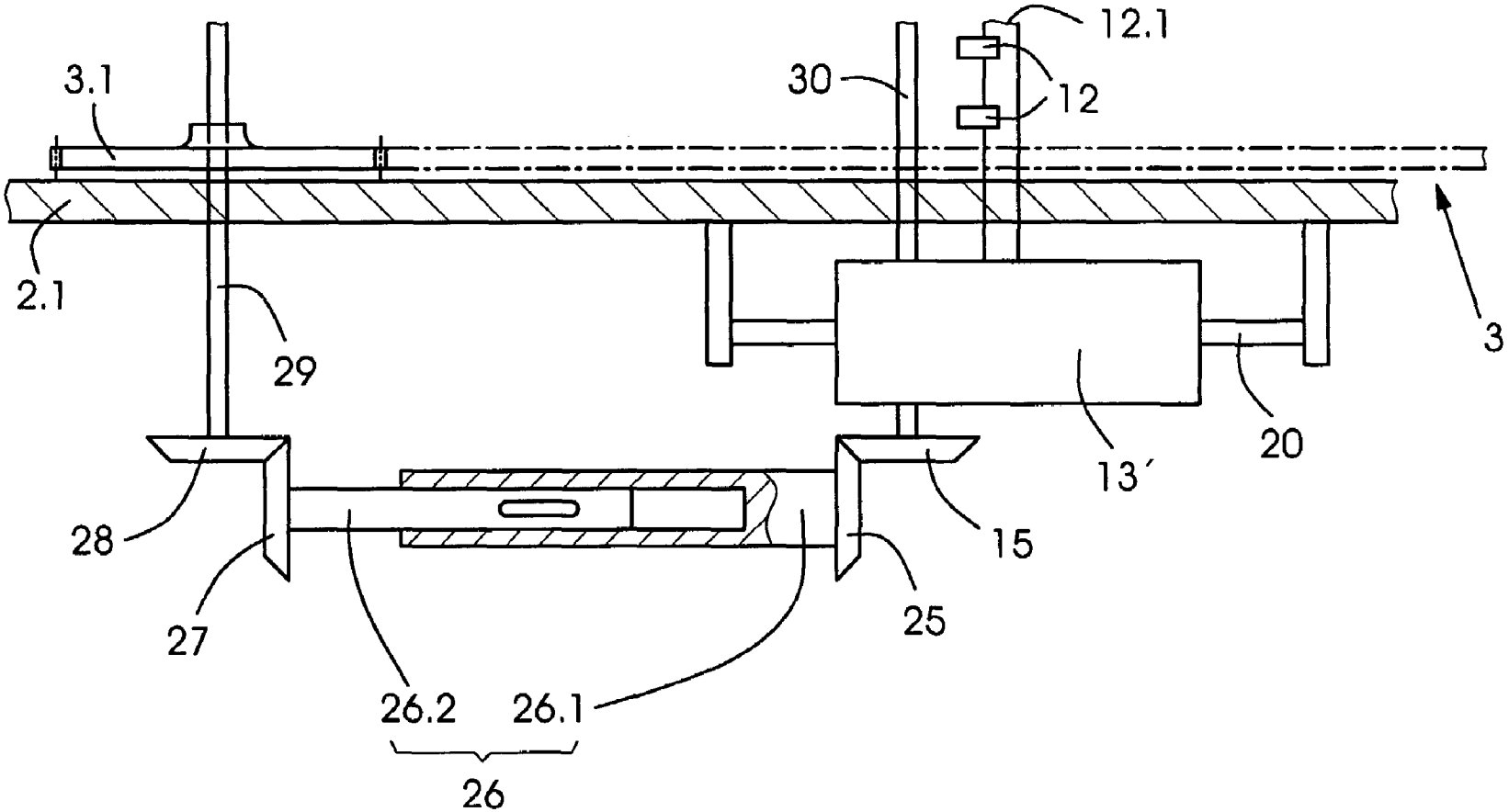
FIG. 3 is diagrammatic, sectional view taken along the line III shown in FIG. 1 of an alternative configuration of the drive that actuates the mechanism.
Figure 4:
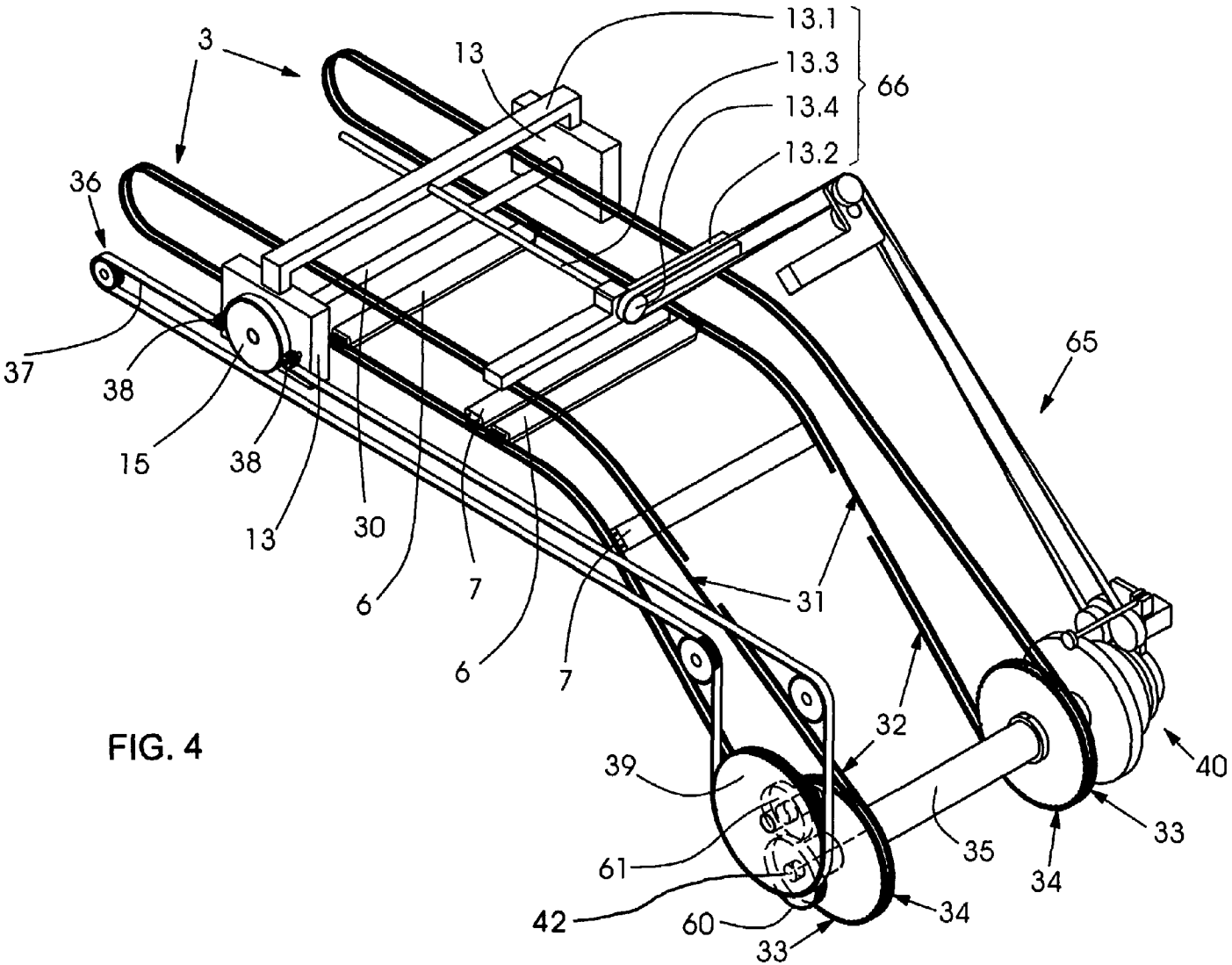
FIG. 4 is a diagrammatic, perspective view of an endless conveyor, guiding the processed sheets at leading and trailing gripper edges and containing two conveyors, to transport the sheets from the last processing station in the direction of the stack, and one configuration of the drive of the mechanism by the endless conveyor.

In order to transfer in particular the trailing edges of the sheets 8 from a sheet-carrying cylinder of the last processing station—here from an impression cylinder 1.1—to the endless conveyor 3, in the present exemplary embodiment according to FIG. 1, recourse is made to the teaching disclosed in Published, Non-Prosecuted German Patent Application DE 100 14 417 A1 with FIGS. 3 and 4 there and the associated description which is hereby incorporated by reference, corresponding to U.S. Pat. No. 6,578,846. In accordance with DE 100 14 417 A1, a sheet guide drum 4 and a transfer drum 5 of appropriate configuration are provided between the impression cylinder 1.1 and the endless conveyor 3.

The endless conveyor 3 contains a first conveyor carrying first gripper bars 6 for gripping leading gripper edges, and a second conveyor carrying second gripper bars 7 for gripping trailing gripper edges, whose phase angle with respect to the first conveyor can be varied in order to adapt to a respective format of the processed sheets and, for this purpose, is for example constructed by using the teaching disclosed in German Patent DE 12 60 482.

The first and second gripper bars 6 and 7 respectively carried by the lower runs of the endless conveyor 3 constructed as chain conveyors take over the sheets 8 from the transfer drum 5 and transport them in the direction of a stack 9 to be built up in a stacking station 2.3, whose upper side is always kept at a substantially constant level—what is known as the production level—by a lifting mechanism. Of the lifting mechanism, a platform 10 carrying the stack 9 and lifting chains 11 carrying the platform are indicated.

To transfer the sheets 8 to the stack 9, after-grippers 12 following a closed after-gripper path 14 during operation are provided, which take over the processed sheets from the endless conveyor 3, more precisely from the second gripper bars 7, guide them along a transport path determined by the lower runs of the endless conveyor 3 and release them above the stack 9. The after-grippers 12 are disposed on a non-illustrated after-gripper bar, which is guided by a mechanism, not specifically illustrated in FIG. 1, which is accommodated in a gearbox 13. An appropriate mechanism is preferably disposed on both sides of the delivery and, here, outside the side frames 2.1 and 2.2 of the latter.

In the event that they are configured as clamping grippers, the after-grippers 12 close under a spring force, in a known manner, and open as a result of rotation of a gripper shaft carrying the after-grippers 12 by a cam follower configuration disposed on the gripper shaft and a gripper opening cam deflecting the latter appropriately. In this case, a respective sheet 8 is taken over at a trailing gripper edge of the same by the after-grippers 12 of one of the second gripper bars 7 guiding the sheet 8 and is transferred to the stack 9.

In an alternative configuration, the after-grippers 12 are constructed as suction grippers and can then advantageously be used in particular when the rotary press is configured exclusively for recto printing operation. The suction grippers then grip the sheets 8 on their unprinted underside and, to this extent, do not need any trailing gripper edge.

The mechanism has in particular a drive wheel 15 which, in the configuration illustrated by way of example here, is driven uniformly via a transmission drive 17 by a motor 16—preferably a geared motor. The motor 16 is disposed on a carrier 18 connected to the gearbox 13. The motor 16 and the transmission drive 17 form a drive 19, which thus, together with a mechanism 24 accommodated in the gearbox 13, forms one structural unit. The gearbox 13 is guided along a stationary rectilinear guide 20 in such a way that the structural unit formed by the mechanism 24 and the drive 19 can be displaced along a horizontal line with respect to the delivery 2.

A mounting 21 likewise fitted in a fixed location bears an actuating motor 22, preferably with a step-down transmission connected downstream, whose output is formed by a threaded spindle 23 which is parallel to the rectilinear guide and which engages with a nut thread permanently disposed on the carrier 18. By appropriate activation of the actuating motor 22, the aforementioned structural unit and therefore, in particular, the mechanism 24 guiding the after-grippers 12 can be set to positions which are correlated with different formats of the processed printing materials.

The drive 19 is configured in such a way that the after-grippers 12 pass through the after-gripper path 14 in the same time as that in which the trailing edge of a following sheet, starting from a specific time, reaches the location assumed by the trailing edge of a preceding sheet at the same time.

The major part of the after-gripper path 14 runs underneath the transport path already mentioned. Only for the purpose of taking over a respective sheet 8 do the after-grippers dip into the transport path. The orientation of the after-grippers 12 in the running direction of the sheets 8 transported by the endless conveyor 3 otherwise remains unchanged during the passage of the after-gripper path 14.

A displacement of the mechanism 24 guiding the after-grippers 12, by the actuating motor 22 and threaded spindle 23, from a first position correlated with the format of a processed sheet 8 into a position correlated with a different format is carried out as required with the motor 16 stopped, that is to say with the machine stopped, or else during the operation of the latter—that is to say with the machine running—for example for the case of position corrections to the gearbox 13. In any case, however, the preset phase angle needed to take over the sheets 8 by the after-grippers 12 from the grippers of a respective second gripper bar 7 and to transfer the sheets 8 to the stack 9, of the mechanism 24 guiding the after-grippers 12 with respect to the printing unit 1 is maintained.

Components corresponding to the components disposed outside the side frame 2.1 (see FIG. 3), the gearbox 13 with the mechanism 24 for guiding the after-grippers 12, the rectilinear guide 20, the drive 19, the actuating motor 22 and the threaded spindle 23, are preferably disposed on both sides of the delivery 2. The gearboxes 13 being connected to each other by a cross-member configuration 13.1 (see FIG. 4), an after-gripper bar 12.1 carrying the after-grippers 12 being fixed at its ends, in each case by a mounting embracing the lower runs of the endless conveyor 3 at the bottom, to the respective mechanism 24 guiding the after-grippers 12, and the drive wheel 15 driving a drive shaft which is common to both mechanisms 24.

Figure 2:
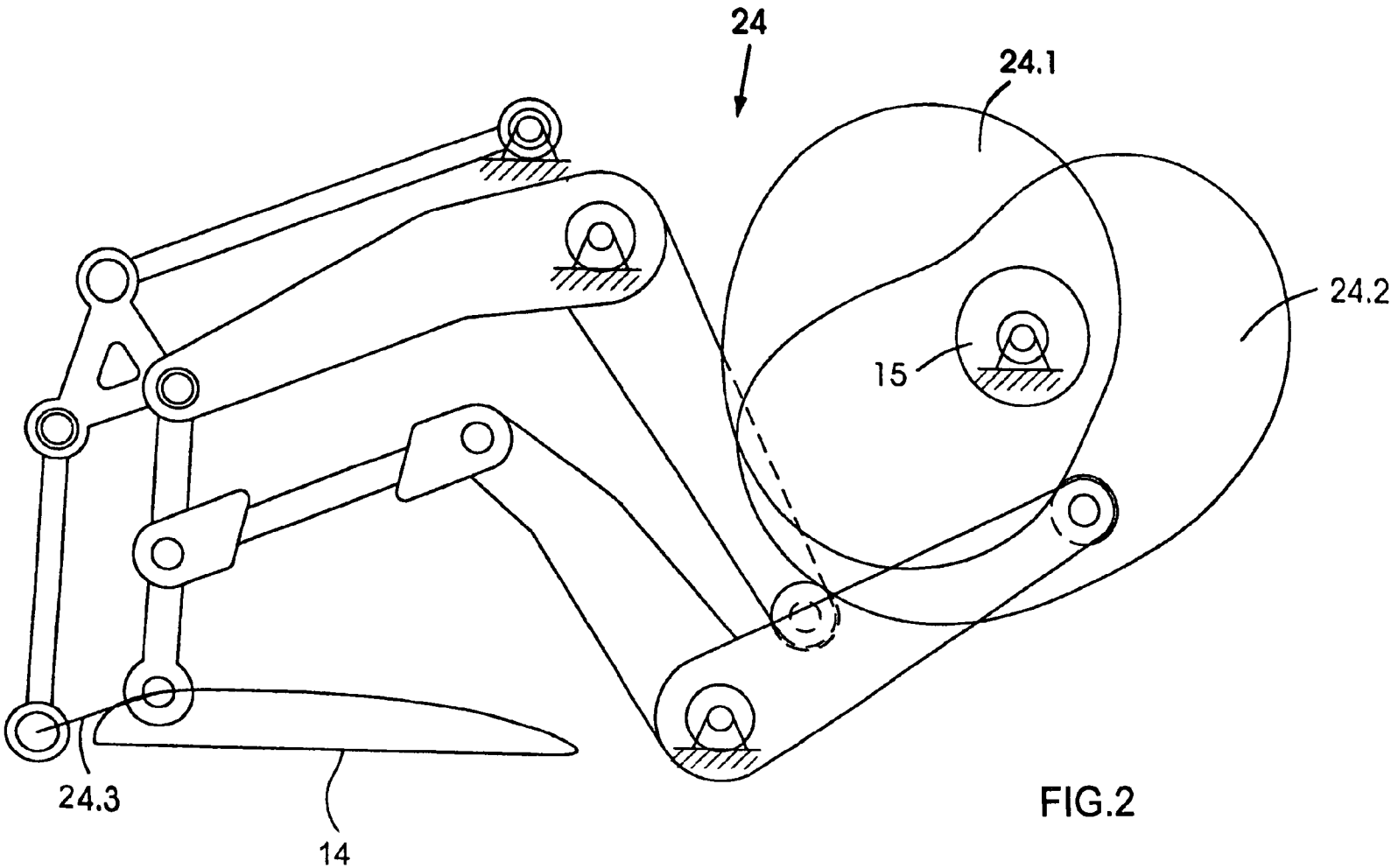
FIG. 2 is an illustration of an exemplary embodiment of the mechanism that guides the after-grippers.

FIG. 2 shows an exemplary embodiment of the mechanism 24 in qualitative terms. It contains a five-element coupler mechanism controlled by two cam disks 24.1 and 24.2 which revolve uniformly during operation and a tracking mechanism attached at one end to the frame and at the other end to joints of the coupler of the coupler mechanism. The mechanism configuration, to such an extent overall forming an after-gripper mechanism, guides a mechanism element provided with the designation 24.3 along a closed coupler curve, while maintaining its orientation, during a revolution of the drive wheel 15, the form of the coupler curve and the law of motion of the guided mechanism element 24.3 being determined by the parameters of the coupler mechanism and the geometry of the cam disks.

The aforementioned fixing of the after-gripper bar 12.1 is carried out to the respective guided mechanism element 24.3. In order to implement the after-gripper mechanism, precautions not illustrated in FIG. 2 must still be taken in order to prevent the cam-controlled mechanism elements lifting off the control cams. The aforementioned frame is understood to mean the gearbox 13. While, in the case of the configuration according to FIG. 1, maintaining the phase angle of the mechanism 24 with respect to the printing unit 1 in the event of changes in the positions of the mechanism 24 is ensured electrically via appropriate activation of the motor 16, maintaining the phase angle in the configurations explained below is implemented mechanically. The common factor in these configurations is that the endless conveyor 3 and the mechanism 24 are connected to each other so as to transmit torque.

In FIG. 3, a variant of a torque-transmitting connection between the endless conveyor 3 and the mechanism accommodated in a gearbox 13' is illustrated in simplified form, the gearbox 13' again being assigned to the rectilinear guide 20 already mentioned and disposed on the outer side of a side frame 2.1 and being capable of being displaced along the rectilinear guide 20 by a non-illustrated device. The drive wheel 15 of the mechanism 24, already mentioned, is formed as a bevel gear and meshes with a bevel gear 25 which is firmly connected to a first end of a telescopic drive shaft 26 so as to rotate with it, the drive shaft 26 for its part being composed of a hollow shaft section 26.1 and a solid shaft section 26.2 engaging in the latter and secured against rotation. The second end of the telescopic drive shaft 26 likewise bears a bevel gear 27 firmly connected to it which, for its part, meshes with a further bevel gear 28, which is firmly connected to a sprocket shaft 29, driven by a turn sprocket 3.1 of the endless conveyor 3 constructed as a chain conveyor here, so as to rotate with it.

In a manner analogous to the configuration according to FIG. 1, a corresponding configuration of the displaceable gearbox 13' is also provided on a side frame 2.2 located opposite the side frame 2.1 and the mechanisms accommodated in the gearbox 13'—for example in each case in the form of the mechanism 24 according to FIG. 2—are driven by a common drive shaft 30 driven by the drive wheel 15.

The step-up ratio between the sprocket shaft 29 and the common drive shaft 30 of the mechanism 24 that guides the after-grippers depends on whether the turn sprocket 3.1 revolves with a single turn or, for example, a half turn. In the case of single-turn revolution, a step-up ratio of 1:1 has to be provided, 1:2 in the case of half-turn revolution.

The configuration reproduced in FIG. 3 relates to the case in which the sheets 8 are guided only at their leading gripper edges by the aforementioned first gripper bars 6. For the case of additional guidance of the trailing gripper edges, a further conveyor guiding the second gripper bars 7—here in the form of a further chain drive—would be required, which would then have a deflection sprocket that could rotate freely with respect to the sprocket shaft 29.

The configuration according to FIG. 3, explained to this extent, has in common with that according to FIG. 1 the fact that position corrections of the gearbox 13' can in particular even be performed when the machine is rotating.

FIG. 4 reproduces a further configuration of a torque-transmitting connection between the endless conveyor 3 and the mechanism 24 which guides the after-grippers, which is again provided in duplicate—on a respective side of the delivery—is accommodated there in a respective gearbox 13 and guides the after-gripper bar 12.1, not illustrated here. The mechanisms 24 are again equipped with the common drive shaft 30 driven by the drive wheel 15.

The endless conveyor 3 is constructed as a chain conveyor and contains a first conveyor 31 and a second conveyor 32. A respective one of the conveyors contains a pair of endless chains in the form of roller chains and, during operation, a respective chain of a pair circulates along the inside of a respective one of the side frames 2.1 and 2.2, not illustrated here. The chains of the first conveyor 31 guide the already mentioned first gripper bars 6 for gripping leading gripper edges of the sheets 8, and the chains of the second conveyor 32 guide the likewise already mentioned second gripper bars 7 for gripping the trailing gripper edges of the sheets 8. In order to grip the trailing gripper edges of the sheets 8 by the gripper bars 7, recourse is made, for example, to the teaching disclosed in Published, Non-Prosecuted German Patent Application DE 100 14 417 A1. To this extent, an illustration of the devices required for this purpose is dispensed with at this point. However, it goes without saying that the trailing gripper edges of the sheets 8 can also be gripped by the second gripper bars in another way.

A respective chain of the first conveyor 31 is disposed in the immediate vicinity of a respective side frame 2.1 or 2.2, wraps around a respective first drive sprocket 33 and, in the same way as a respective chain of the second conveyor 32, in particular in regions of direction changes of the chain, runs along chain guides not illustrated here. A respective chain of the second conveyor 32 runs along a chain path which is congruent with the chain path through which the first chains pass and wraps around a respective second drive sprocket 34. The second drive sprockets 34 are disposed between the first drive sprockets 33, in each case in the immediate vicinity of the latter, and their phase angle with respect to the first drive sprockets 33 can be adjusted in a manner explained in more detail later.

The first and second drive sprockets 33 and 34—as explained in more detail later—have a common torque-transmitting connection in production printing operation with a gear wheel of a gear train provided to drive the machine and, in a manner likewise explained in more detail later, are disposed on a sprocket shaft 35, which bears a gear wheel driving the latter and meshing with the aforementioned gear wheel of the gear train and, in the mode of illustration of FIG. 4, rotates in the clockwise direction when in operation.

The gearbox 13 containing the mechanism 24 for guiding the after-grippers 12 not illustrated in FIG. 4 is disposed with respect to the stack 9, likewise not illustrated here, in accordance with its mutual association which can be gathered from FIG. 1 and can be displaced along a rectilinear guide 20 indicated there (not shown in FIG. 4).

The drive wheel 15 of the mechanism 24 is incorporated in a flexible drive 36, driven by the endless conveyor 3 during operation, in such a way that a flexible drive run 37 of the flexible drive 36 running parallel to the non-illustrated rectilinear guide 20 for the gearbox 13 (see FIG. 1) wraps around the drive wheel 15 and a deflection wheel 38 connected upstream of the latter and one connected downstream. The flexible drive 36 contains a drive wheel 39 that, in a manner explained in more detail later, has a drive connection to the endless conveyor 3. Overall, therefore, between the mechanism 24 that guides the after-grippers 12 and the endless conveyor 3, a torque-transmitting connection is produced via the flexible drive 36 by an endless flexible drive which acts on the drive wheel 15 and therefore on the mechanism 24, so that, ultimately, as also in the case of the variant according to FIG. 3, the endless conveyor 3 constitutes a drive for the mechanism 24.

As explained in more detail below, in the configuration according to FIG. 4, the setting of the mechanism 24 to positions correlated with different formats of the processed printing materials while maintaining one and the same phase angle of the mechanism 24 with respect to the printing unit 1 by the drive that actuates the mechanism 24—here, ultimately, the flexible drive 36—is coupled mechanically to a setting of the second gripper bars 7, guiding the trailing gripper edges of the sheets 8, to the respective format.

For this purpose, inter alia, a rotary coupling 40 according to FIG. 4, assigned to the endless conveyor 3, is provided.

The construction of the rotary coupling 40, its function and its interaction with an actuating drive to be explained in more detail later can be gathered from FIGS. 5 and 6. By use of the actuating drive, the second gripper bars 7 guiding the trailing gripper edges of the sheets are set to the format of the sheets 8 and, at the same time, the mechanism 24, that is to say the gearbox 13, is set to a position that correlates with this format.

The rotary coupling 40, which can be adjusted from a first into a second operating state and vice versa, is reproduced in the first operating state in FIG. 5 and, as explained below, in this operating state produces a drive connection between the first conveyor 31—represented here by the first drive sprocket 33—and the second conveyor 32—represented here by the second drive sprocket 34.

As already indicated at an earlier point and now explained in more detail, the first drive sprockets 33 and the second drive sprockets 34 are disposed on the sprocket shaft 35. The latter is constructed as a hollow shaft. The sprocket shaft 35 is mounted in the side frames 2.1 and 2.2 such that it can rotate, only the side frame 2.2 being reproduced in FIG. 5. Firmly connected to the sprocket shaft 35 so as to rotate with it is a gear wheel 41, which meshes with the gear wheel already mentioned but not illustrated here belonging to the gear train, already mentioned, for driving the machine. The first drive sprockets 33 are firmly connected to the sprocket shaft 35 in a manner not specifically illustrated so as to rotate with it, while the second drive sprockets 34 are mounted on the sprocket shaft 35 such that they can rotate, but for this purpose have a rotationally fixed connection to a drive shaft 42 which passes through the sprocket shaft 35, to be specific in each case via a driver 43 which is provided on the one hand on the drive shaft 42 and on the other hand on the respective second drive sprocket 34 and which passes through a slot 44 running through the sprocket shaft 35 in the circumferential direction and formed in the latter.

Figure 5:
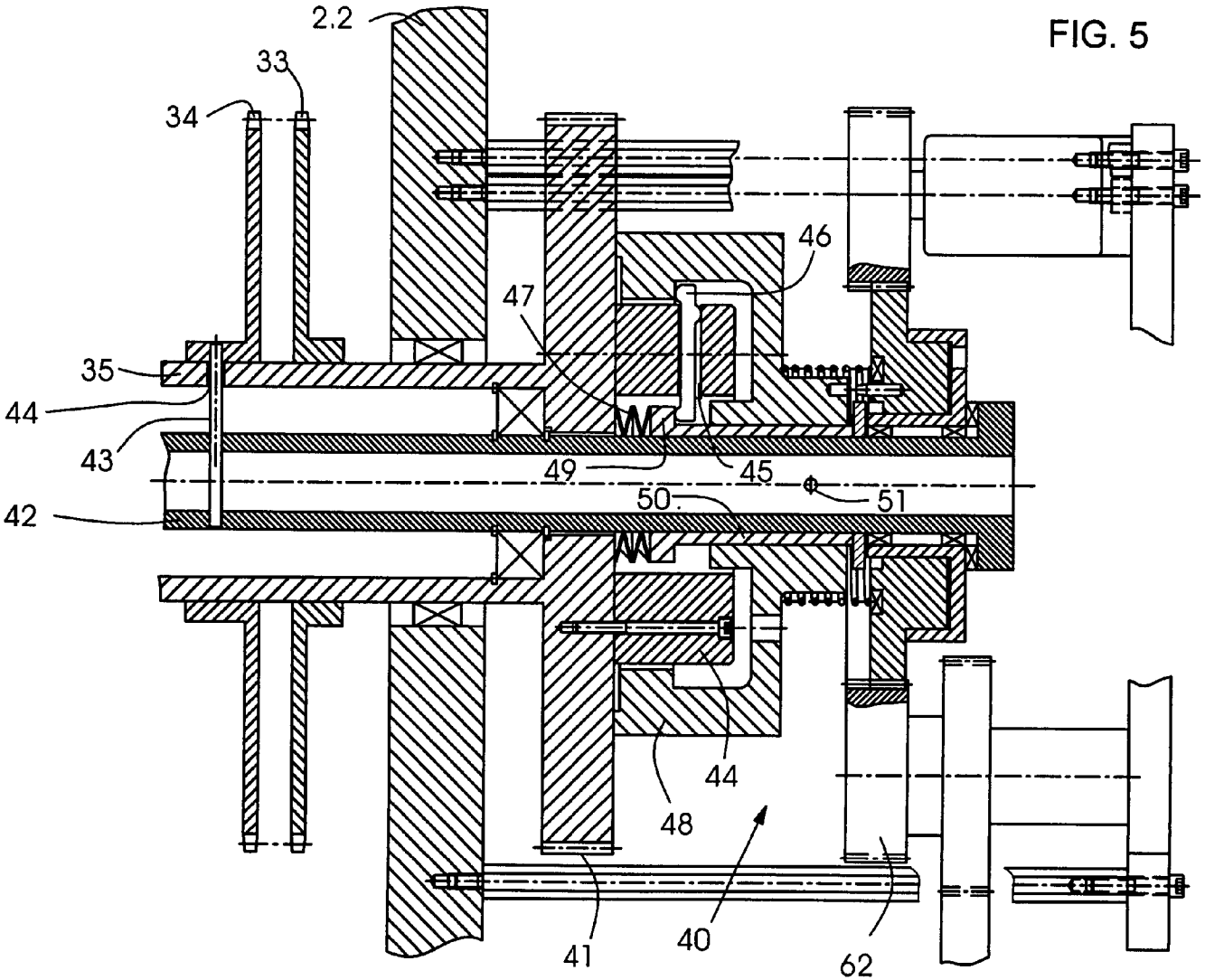
FIG. 5 is a diagrammatic, sectional view of an example of a rotary coupling which, in a first operating state, produces a drive connection between the two conveyors and, in a second operating state, cancels the drive connection, and also an example of the attachment of an actuating drive, provided for the mutual phase shifting of the two conveyors, to the endless conveyor and for using the actuating drive to set the mechanism that guides the after-grippers to its positions correlated with the format of the processed sheets, the rotary coupling being illustrated in its first operating state.
Figure 6:
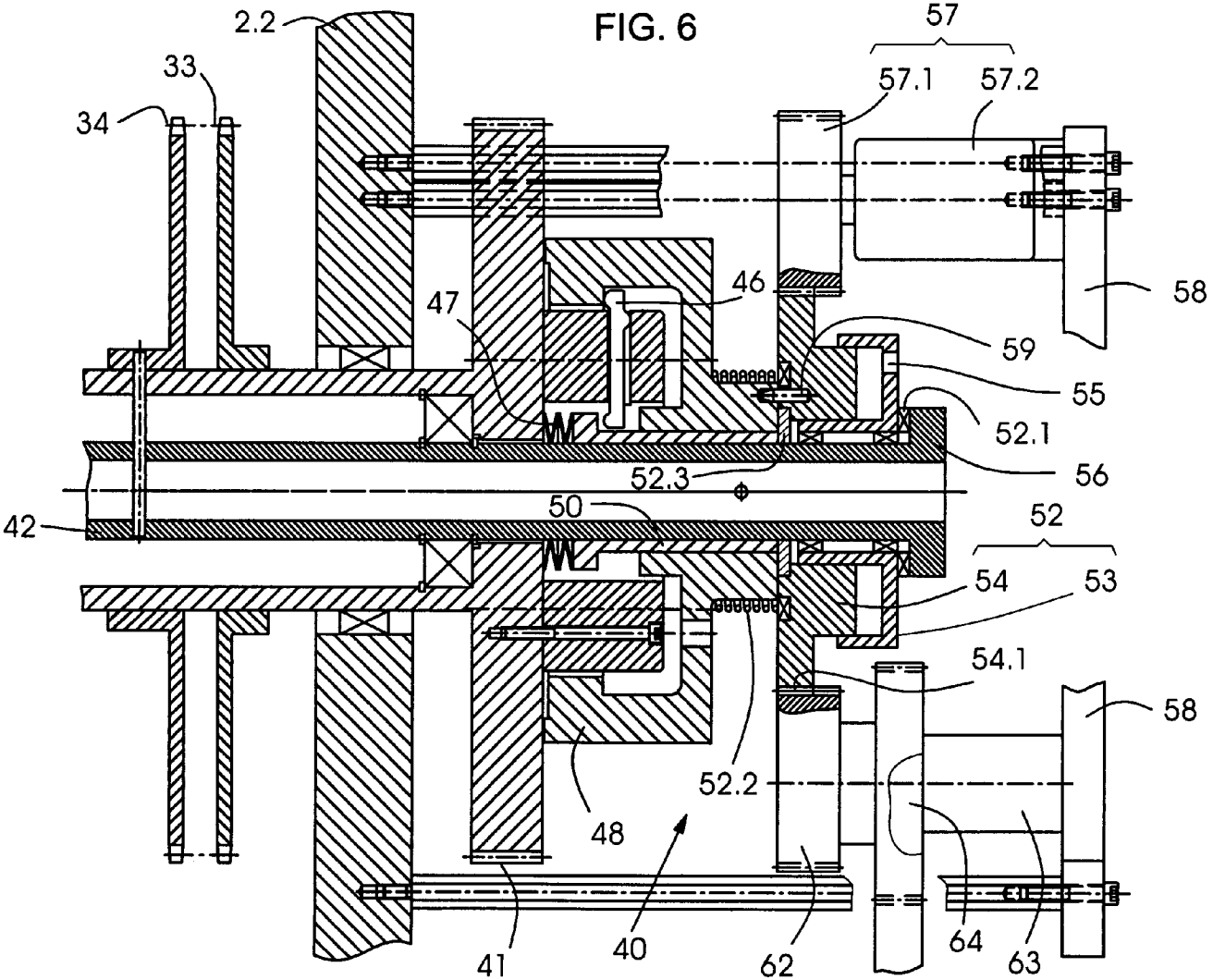
FIG. 6 is a diagrammatic, sectional view of the components reproduced in FIG. 5 in the second operating state of the rotary coupling.

The rotary coupling 40 contains an inner coupling ring 44 which is firmly connected to the gear wheel 41—and thus to the sprocket shaft 35 and the first drive sprockets 33—on which tilting levers 46 are supported in radial recesses 45 in the same and, in the first operating state, illustrated in FIG. 6 and present during production printing of the machine, press an outer coupling ring 48 onto the gear wheel under the action of a disk spring pack 47. The disk spring pack 47 is supported on one side on the gear wheel 41 and on the other side on a shoulder 49 of a pressure sleeve 50, which is mounted on the drive shaft 42 such that it can be displaced longitudinally, passes through a hub of the outer coupling ring 48 and projects beyond both ends of this hub. The hub of the outer coupling ring 48 is mounted on the drive shaft 42 and firmly connected to the latter so as to rotate with it via a pin 51. Adjacent to its shoulder 49, the pressure sleeve 50 has an open cross section which extends only over mutually opposite circumferential sections which, in the illustration of FIG. 5, are located above and below the drive shaft 42 and are embedded in corresponding longitudinal grooves of a bore, otherwise nestling against the circumferential surface of the drive shaft 42, in the hub of the outer coupling ring 48. This ensures that the outer coupling ring 48 and the drive shaft 42 connected to the latter via the pin 51 can be rotated, in particular also with respect to the pressure sleeve 50, in a second operating state of the rotary coupling—that is to say with the pressure between the gear wheel 41 and the outer coupling ring 48 removed.

However, in the first operating state of the rotary coupling 40, illustrated in FIG. 5, under the action of the disk spring pack 47, the outer coupling ring 48 is pressed against the gear wheel 41 and thus, via the drive shaft 42 pinned to the outer coupling ring 48 and the driver 43 firmly connecting the latter to the second drive sprockets 34 so as to rotate with them, a drive connection is produced between the first conveyor 31—represented here by the first drive sprocket 33—and the second conveyor 32—represented here by the second drive sprocket 34.

As already indicated at an earlier point and previously explained in more detail, during production printing operation of the machine, therefore, the first and second drive sprockets 33 and 34 jointly have a torque-transmitting connection to a gear which is not illustrated here but meshes with the gear wheel 41 and belongs to a gear train provided to drive the machine.

FIG. 6 reproduces the rotary coupling 40 in its second operating state. In the second operating state, the adjustment of the phase angle of the second drive sprockets 34 with respect to the first drive sprockets 33, already indicated at an earlier point and now explained in more detail, is possible. In order to bring about this second operating state, the action of the disk spring pack 47 on the tilting levers 46 is canceled by axial displacement of the pressure sleeve 50 in the direction of the disk spring pack 47, as a result of which the force flow between the gear wheel 41 and the outer coupling ring 48, existing in the first operating state, is broken. In this way, therefore, the drive connection between the first conveyor 31, that is to say the first drive sprocket 33, and the second conveyor 32, that is to say the second drive sprocket 34, is canceled and thus the second conveyor 32 is released for a phase adjustment with respect to the first conveyor 31.

In order to bring about the aforementioned axial displacement of the pressure sleeve 50 in the direction of the disk spring pack 47, a piston-cylinder unit 52 which, for example, can be actuated hydraulically, having a cylinder 53 and a piston 54 is provided. The piston-cylinder unit 52 is connected by a connection 55 to a pressure medium system, not illustrated here, and, in the second operating state, is under the action of a corresponding pressure medium, for example hydraulic fluid.

The cylinder 53 is rotatably mounted on a section of the drive shaft 42 which projects beyond the outer coupling ring 48 and which follows sections of the drive shaft 42 which successively pass through the sprocket shaft 35, the gear wheel 41 and the pressure sleeve 50, and is supported via an axial bearing 52.1 on a shoulder 56 at the end of that section of the drive shaft 42 which projects beyond the outer coupling ring 48.

In the second operating state of the rotary coupling 40, which is illustrated in FIG. 6 and in which the piston 54 is extended under the action of the pressure medium fed in via the connection 55, the piston 54 presses against the pressure sleeve 50 via a pressure ring 52.3 carried by the drive shaft 42, the pressure sleeve 50 then in turn compressing the disk spring pack 47 and thus canceling its action on the tilting levers 46, so that ultimately the force flow between the outer coupling ring 48 and the gear wheel 41 is broken and the second drive sprockets 34 can be rotated with respect to the first drive sprockets 33.

The piston 54 is provided with a toothed ring 54.1. Meshing with the latter is a pinion 57.1 of an actuating drive 57, already mentioned at an earlier point and now explained in more detail, which here contains a motor 57.2 which is flange-mounted on a mounting 58 fixed to the side frame 2.2 via studs. The pinion 57.1 is configured to be broad such that, in both operating states of the rotary coupling, that is to say in the extended and non-extended state of the piston 54, it meshes with the toothed ring 54.1.

At an end of the piston 54 facing the outer coupling ring 48, the former bears at least one driver 59 which, in the extended state of the piston 54, produces a form-fitting connection between the piston 54 and the outer coupling ring 48.

The phase angle of the second conveyor 32—represented here by the second drive sprocket 34—can thus be adjusted by the actuating drive 57 for the purpose of rotation with respect to the first conveyor 31—represented here by the first drive sprocket 33—in the second operating state of the rotary coupling 40, to be specific on the basis of the drive connection between the actuating drive 57 and the second conveyor 32 which exists in the second operating state of the rotary coupling 40. When setting the endless conveyor 3 from one format of the processed sheets to another, a corresponding adjustment is carried out and used to set the distance of the second gripper bars 7, guiding the trailing gripper edges of the sheets 8, from the first gripper bars 6 guiding the leading gripper edges of the sheets 8.

After adjustment has been carried out, the rotary coupling 40 is set back into its first operating state, in which the actuating drive 57 is then uncoupled from the second conveyor 32. For this purpose, the connection 55 provided on the cylinder 53 is depressurized, so that, by a return spring 52.2 (see FIG. 6), the rotary connection previously existing via the driver 59 between the piston 54 and the outer coupling ring 48 is broken and the frictional connection between the latter and the gear wheel 41, and therefore the drive connection between the second conveyor 32 and the first conveyor 31, is produced again.

As FIG. 4 reveals, as already indicated at an earlier point and now explained in more detail, the drive wheel 39 of the flexible drive 36 driving the mechanism 24, and therefore the mechanism 24, is in a torque-transmitting connection with the endless conveyor, more precisely, this connection is with the second conveyor 32 of the endless conveyor 3. For this purpose, the drive shaft 42 passing through the sprocket shaft 35 is led out of the side frame 2.1 on the side of the flexible drive 36 (see FIG. 4) and, via intermeshing intermediate wheels 60 and 61, a drive connection is produced between the drive shaft 42 and the drive wheel 39, the intermediate wheel 60 being firmly connected so as to rotate with the drive shaft 42 (see FIGS. 5 and 6) led out of the side frame 2.1 (see FIG. 4), and the intermediate wheel 61 being firmly connected so as to rotate with the drive wheel 39.

As FIGS. 5 and 6 reveal, the toothed ring 54.1 of the piston 54 also meshes with a gear wheel 62. The latter is firmly connected so as to rotate with a shaft 63, which is rotatably mounted in the mounting 58, and firmly connected so as to rotate with a drive wheel 64 of a transmission drive 65 reproduced in FIG. 4.

In order to set the mechanism 24, in other words the gearboxes 13, to positions correlated with the format of the processed sheets 8, an actuating device that can be actuated rotationally is provided and, for this purpose, is provided with an actuating wheel 13.4. In the present exemplary embodiment, the actuating device is constructed in the form of a spindle drive 66 which can be actuated by the aforementioned transmission drive 65.

According to FIG. 4, provided for this purpose is a cross-member 13.2 which is disposed fixed to the frame in a manner not specifically illustrated, in which a threaded spindle 13.3 oriented in the adjustment direction of the gearboxes 13 is mounted such that it is fixed axially but can be rotated. The threaded spindle 13.3 interacts with a corresponding thread provided in the cross-member configuration 13.1 in order to connect the two gearboxes 13 and is firmly connected to the above-mentioned actuating wheel 13.4 so as to rotate with it, the latter in turn being incorporated in the transmission drive 65, so that overall there is therefore a drive connection between the actuating wheel 13.4 and the actuating drive 57 according to FIG. 6.

Overall, therefore, there are actuating unit in the form of the toothed ring 54.1 of the piston 54, in the form of the transmission drive 65 and in the form of the spindle drive 66 which, in the second operating state of the rotary coupling 40, that is to say when the second conveyor 32 is uncoupled from the first conveyor 31, can be actuated jointly and in a mechanically coupled manner by the actuating drive 57 to the effect that a change in the phase angle of the second conveyor 32 with respect to the first conveyor 31 is carried out in order to adapt the distance of the second gripper bars 7 from the first gripper bars 6 to a different format of the sheets 8, and to adjust the mechanism 24 to a position correlated with this format.

However, these adjustment operations proceed without any change in the phase angle of the mechanism 24 with respect to the printing unit 1. For this purpose, the parameters of the transmission drive 65 (see FIG. 4), including the gear wheel 62 which drives the latter (see FIGS. 5 and 6), of the spindle drive 66, of the flexible drive 36 and of the drive wheel 15, are coordinated with that of the endless conveyor 3 in such a way that when the positions of the mechanism 24, that is to say of the gearboxes 13, are changed, the flexible drive 36 is driven in such a way that the drive wheel 15 actuating the mechanism 24 is at a standstill, that is to say that the mechanism 24 is not actuated.

In the case of the configuration of the flexible drive 36 according to FIG. 4, the coordinations carried out for this purpose in particular also include the suitable selection of its direction of circulation. Because of the intermediate wheels 60 and 61 already mentioned, this is opposite to the direction of circulation of the endless conveyor 3 during operation.

As opposed to the configuration according to FIG. 1, in that according to FIG. 4, half-turn drive sprockets 33 and 34 are provided, for which the aforementioned coordination between the parameters contains the measures of configuring the pitch circle of the drive wheel 15 to be half the size of those of the drive sprockets 33 and 34. Given this diameter ratio and given the aforementioned circulation directions, on the one hand of the endless conveyor 3 in the clockwise direction and on the other hand of the flexible drive 36 in the counterclockwise direction, during an adjustment of the position of the gearboxes 13 by the flexible drive 36, the drive wheel 15 is driven in the opposite direction to that in which it would roll on the flexible drive 36 during the aforementioned adjustment when the latter was at a standstill. Thus, the drive wheel 15, and therefore the mechanism 24, is stationary during a change of its positions correlated with different formats of the processed sheets.

Figure 7:
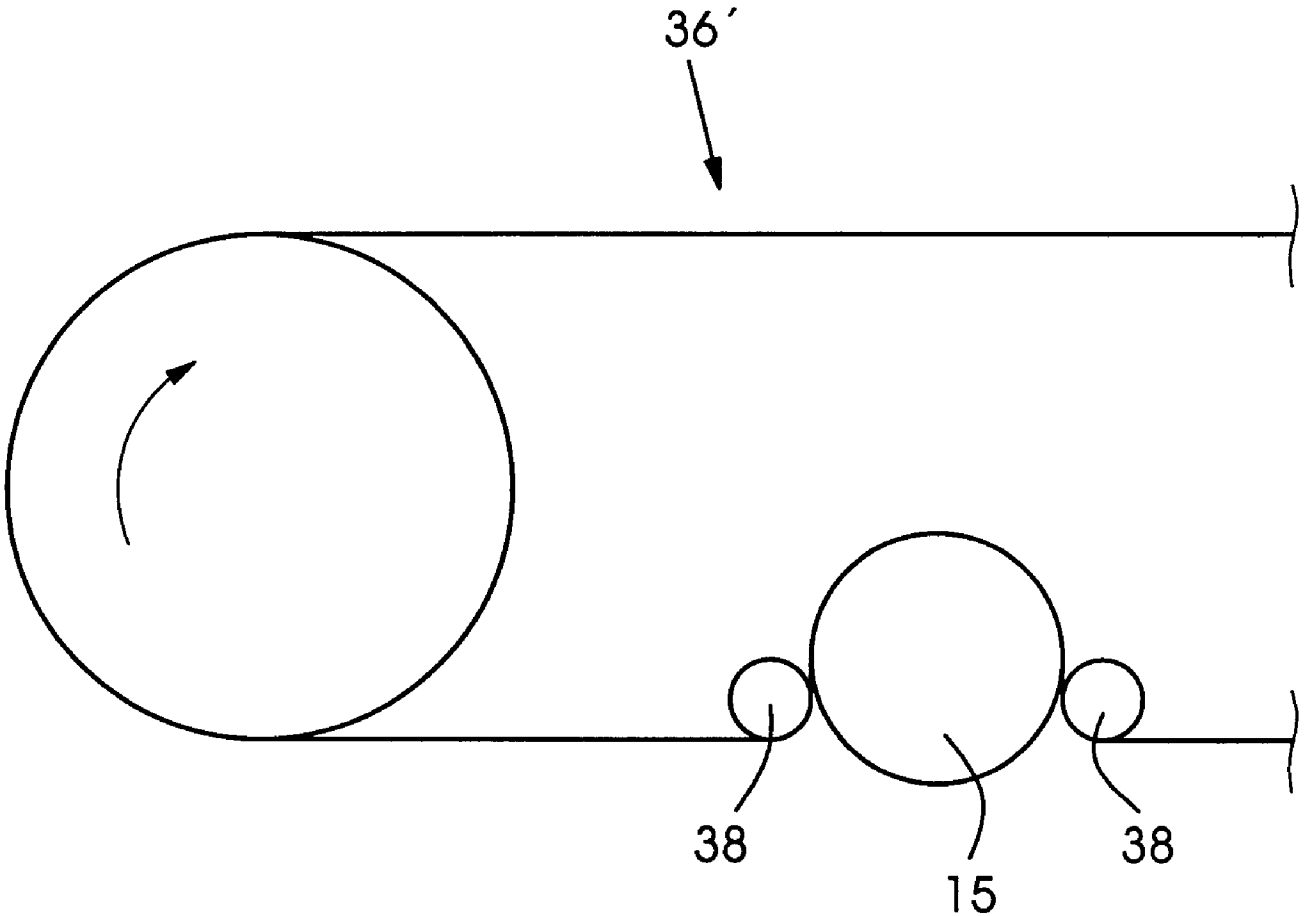
FIG. 7 is an illustration of an alternative configuration of the drive of the mechanism by use of the endless conveyor.

In the section of a flexible drive 36' reproduced in FIG. 7 and containing the drive wheel 15, as opposed to the configuration of the flexible drive 36 according to FIG. 4, a lower flexible drive unit runs parallel to the horizontal rectilinear guide 20 likewise not reproduced here (see FIG. 1) has a drive connection with the drive wheel 15 in a manner otherwise analogous to FIG. 4. Although the flexible drive 36' is likewise driven via a drive wheel 39 according to FIG. 4, the latter is firmly connected directly so as to rotate with the drive shaft 42 passing through the sprocket shaft 35 without any configuration of intermediate wheels (intermediate wheels 60 and 61 in FIG. 4), so that the flexible drive 36' circulates in the clockwise direction in the same manner as the endless conveyor.

Again, given a half-turn configuration of the drive sprockets 33 and 34, there is the same diameter ratio between the pitch circle of the drive wheel 39 (see FIG. 4) and that of the drive wheel 15 as in the case of the configuration according to FIG. 4 and, with the already mentioned coordination of all the other parameters, the result for the flexible drive 36' is also standstill of the drive wheel 15 during a change in the positions of the gearboxes 13 in order to adapt to the format of the processed sheets 8, so that in this case, likewise, the maintenance of the phase angle of the mechanism 24 in relation to the printing unit 1 is ensured.

In an alternative refinement, the torque for driving the flexible drive 36' according to FIG. 7 can also be tapped off a deflection sprocket, not illustrated, belonging to the second conveyor 32. In this case, the sprocket following the left-hand drive wheel 38 in FIG. 7 would be the drive wheel for the flexible drive 36', and it would have a torque-transmitting connection with one of the deflection sprockets, not illustrated, belonging to the second conveyor 32. The section of the flexible drive unit not illustrated in FIG. 7 would then merely wrap around one deflection wheel instead of the drive wheel 39.

In the case of a direct rotationally fixed connection between a deflection sprocket of the second conveyor 32 and the aforementioned drive wheel for the alternative drive of the flexible drive 36', it goes without saying that this drive wheel has the same diameter as the drive wheel 39, in the same way as that of the second drive sprockets 34 and otherwise—in the configuration present here of the mechanical coupling between the adjustment operations to match the position of the second gripper bars 7 and the after-grippers 12 to the respective format of the processed sheets 8—also the first drive sprocket 33, so that, during a position change to the gearboxes 13, standstill of the drive wheel 15 and therefore the mechanism 24 is again established.

If the sheet-processing machine has a delivery with an endless conveyor that grips the sheets 8 only at their leading edges, then it is equipped with a sheet guide device over which the sheets 8 are drawn. For the case in which the machine is configured for optional operation in the recto and verso printing processes or in the recto printing process, the aforementioned sheet guide device for the first operating mode is preferably configured to produce an air cushion between a respective sheet 8 and a guide surface provided on the sheet guide device. For this purpose, the sheet guide device is connected to a pneumatic system by which sheet-carrying air streams are expelled from air passage openings that are provided in the guide surface.

For the case of the second operating mode, the aforementioned air passage openings communicate with a vacuum generator belonging to the pneumatic system, so that the sheets 8 drawn over the sheet guide devices rest in a defined way on the guide surface.

The sheet guide device can preferably be set to different formats of the sheets 8.

Figure 8:
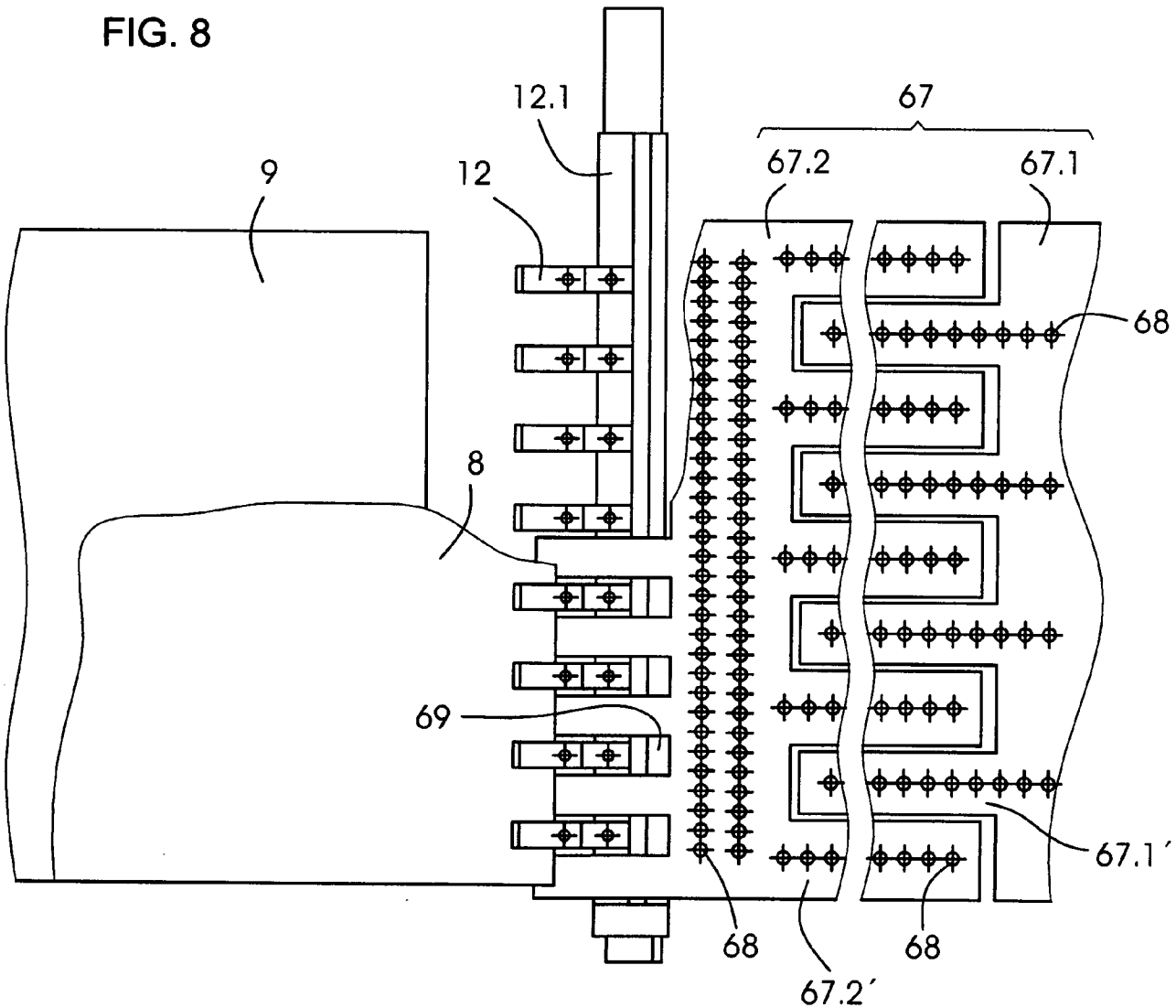
FIG. 8 is a diagrammatic, plan view of the stack, an after-gripper bar carrying the after-grippers and a sheet guide device which can be set to different formats of the sheets.

FIG. 8 reproduces a preferred configuration of such a sheet guide device 67 in simplified form in a plan view. In this case, air passage openings 68 that, during operation, discharge sheet-carrying air streams or communicate with a vacuum generator are merely indicated schematically in terms of their configuration and arrangement.

The sheet guide device 67 contains a stationary first guide section 67.1 and a second guide section 67.2 which follows the former in the direction of the stack 9, adjoins the stationary guide section 67.1 and can be set to different formats of the sheets 8, the first guide section 67.1 and the second guide section 67.2 having mutually facing end sections 67.1' and 67.2' which interengage in the manner of a comb.

In the position illustrated in FIG. 8 of the second guide section 67.2 with respect to the first guide section 67.1, the sheet guide device 67 is set to the maximum format of the sheets 8 which can be processed by the machine.

In order to set the second guide section 67.2 to smaller formats, the latter, together with the after-gripper bar 12.1, is displaced in the direction of the stack 9 and, for this purpose, is preferably fixed to the gearboxes 13.

At an end of the second guide section 67.2 facing the stack 9, clearances 69 are formed, in which the after-grippers 12—which can be constructed as clamping or else sucking grippers—engage in order to take over the sheets 8 from the endless conveyor 3.

The end sections 67.1' and 67.2' interengaging in the manner of a comb are dimensioned such that, when the second guide section 67.2 is set to the smallest processable format of the sheets 8, the end sections 67.1' and 67.2' still intermesh, so that, when processing sheets 8 with a format smaller than the maximum format, a guiding action transversely with respect to the sheet running direction is maintained on the part of the sheet guide device 67, at least in some sections.

We claim:

1. A sheet-processing machine, comprising:

at least one processing station being a printing unit;

a stacking station for holding a stack formed from processed sheets and disposed downstream of said printing unit;

a delivery with an endless conveyor transporting the processed sheets in a direction of the stack and disposed downstream of said printing unit;

after-grippers following an annular after-gripper path during operation for taking over the processed sheets from said endless conveyor and releasing the processed sheets over the stack;

an after-gripper bar having said after-grippers disposed thereon;

a mechanism guiding said after-gripper bar together with said after-grippers along said annular after-gripper path, said mechanism being set to positions correlating with different formats of the processed sheets;

said endless conveyor and said mechanism having a torque-transmitting connection with each other, said torque-transmitting connection being a flexible drive having an endless flexible drive unit acting on said mechanism; and a drive actuating said mechanism, said drive keeping said mechanism at one and the same phase angle with respect to said printing unit in each of the positions.

2. The machine according to claim 1, wherein said mechanism and said drive form one structural unit disposed to be displaced with respect to said delivery.

3. The machine according to claim 1, wherein during a change in the positions of said mechanism, said flexible drive is driven such that said mechanism is not actuated.

4. The machine according to claim 1, wherein said endless conveyor contains a first conveyor and a second conveyor, said first conveyor having and bearing first gripper bars for gripping leading gripper edges of the processed sheets, and said second conveyor having and bearing second gripper bars for gripping trailing gripper edges; and further comprising a rotary coupling operating in one of a first operating state and a second operating state, operating in the first operating state produces a drive connection between said first conveyor and said second conveyor and, operating in the second operating state releases said second conveyor for a phase adjustment with respect to said first conveyor, and said torque-transmitting connection between said mechanism and said endless conveyor exists with said second conveyor.

5. The machine according to claim 4, further comprising an actuating drive having a drive connection to said second conveyor through said rotary coupling in a second operating state of rotary coupling and, in a first operating state of said rotary coupling, said actuating drive is uncoupled from said second conveyor.

6. The machine according to claim 5, further comprising:

a further actuating device actuated rotationally and having an actuating wheel for setting the positions of said mechanism; and a drive connection between said actuating wheel and said actuating drive.

7. A rotary press, comprising:

at least one processing station being a printing unit;

a stacking station for holding a stack formed from processed sheets and disposed downstream of said printing unit;

a delivery with an endless conveyor transporting the processed sheets in a direction of the stack and disposed downstream of said printing unit;

after-grippers following an after-gripper path during operation and taking over the processed sheets from said endless conveyor and releasing the processed sheets over the stack;

said delivery having a sheet guide device which can be set to different formats of the processed sheets, said sheet guide device having ends with clearances formed therein, said after-grippers engaging in said clearances and taking over the processed sheets from said endless conveyor;

a mechanism guiding said after-grippers, said mechanism being set to positions correlating with different formats of the processed sheets; and a drive for actuating said mechanism, said drive keeping said mechanism at one and the saute phase angle with respect to said printing unit in each of the positions.

8. The machine according to claim 7, wherein said sheet guide device has a stationary first guide section and a second guide section following said stationary first guide section in a direction of the stack and adjoins said stationary first guide section, said second guide section can be adjusted for accommodating different formats of the processed sheets, said first stationary first guide section and said second guide section have mutually facing end sections which interengage in a manner of a comb, and said clearances are formed in said second guide section.

* * * * *